US005893587A

United States Patent [19]

Wong

[11] Patent Number: 5,893,587

[45] Date of Patent: Apr. 13, 1999

[54] TAMPER INDICATING LABEL

[76] Inventor: Ka Hei Wong, 101 Grassy Plain Rd., East Providence, R.I. 02915

[21] Appl. No.: 08/902,601

[22] Filed: Aug. 12, 1997

[51] Int. Cl.[6] ..... B42D 15/00

[52] U.S. Cl. ..... 283/98; 283/72; 283/81

[58] Field of Search ..... 283/72, 81, 80, 283/79, 98, 99; 428/916; 40/299, 638, 630

[56] References Cited

U.S. PATENT DOCUMENTS

| | | | |
|---|---|---|---|
| 563,490 | 7/1896 | Kallman | 283/98 |
| 3,505,954 | 4/1970 | Projansky | 283/98 |
| 3,650,210 | 3/1972 | Archen | 283/98 |
| 4,573,711 | 3/1986 | Hyde | 283/98 |

FOREIGN PATENT DOCUMENTS

| | | | |
|---|---|---|---|
| 2064430 | 6/1981 | United Kingdom | 283/98 |

*Primary Examiner*—Willmon Fridie, Jr.
*Attorney, Agent, or Firm*—Robert J Doherty

[57] ABSTRACT

A tamper indicating label including an upper sheet having an adhesive lower surface detachably attached to a backing sheet and divided into separable sections by a weakened line such that indicia such as the user's signature can be inscribed on the face of the sheet and across the weakened line such that one of the sections can be separated from the backing sheet and applied to the opening seam of an article such as a suitcase and the remaining section utilized as a receipt.

7 Claims, 3 Drawing Sheets

TAMPER INDICATING LABEL

BACKGROUND AND OBJECTS OF THE INVENTION

The present invention relates generally to a tamper indicating label which can be applied to an article surface having at least two segments with one segment thereof being movable relative to the other along a segment dividing line such as luggage, brief cases, jewelry boxes, folders, desk drawers, filing, liquor and gun cabinets, music and video storage units, collectible and curio display cases and the like. In particular, the present invention is specifically directed to a self-adhesive label which can be peeled from a backing member and applied to such articles across the segment dividing line such that that section of the label applied to the article would have to be removed or broken in order to open the article, and thus the owner would be able to determine such unauthorized access.

Most security devices for locking luggage, brief cases, filing cabinets and the like have the disadvantage that an individual may be able to open and subsequently close the article without the owner's knowledge leaving no evidence that someone had gained access to the item or article to which the security device was attached. This is a particular problem with regard to luggage which is checked through to a forward destination such as in airline or train travel. It, accordingly, would be desirable to be able to provide such a security device preferably in the form of a label which is sealed across the movable segments of the article at the time of checking or beforehand and which not only would serve as an indication that the article had been opened upon arrival at the destination point but also would be a deterrent to those limited number of people having access to the article during such travel.

Security seals of this general type are known, and one such seal is described in U.S. Pat. No. 2,013,299 to Byrne in which an adhesively-backed paper label bearing an authorized signature is adhered across the junction between the lid and base of a box. Thus, the box cannot be opened without removing or tearing the label; and since the label bears the owner's signature, this adds an additional deterrent. While helpful, this label can be entirely removed and a new label with a forged signature of the owner placed thereon after unauthorized access; and the owner, upon receipt of the article, would be unaware of such unauthorized access assuming, of course, that the signature copy was of high quality. This circumvention of the safety device disclosed would be possible since the entire signature on the label is clearly visible and thus available for copying.

Other attempts to provide tamper indicating labels include that device shown in U.S. Pat. No. 5,560,657 to Morgan in which connecting loops or straps are adhered between tear resistant paper layers which can include the owner's signature, and the device shown in U.S. Pat. No. 4,787,158 to Vitol in which a pricing label is provided with adhesive portions to make it more difficult to switch price tags on articles to which they are attached.

SUMMARY OF THE INVENTION

Despite the above suggested products, the need exists for a tamper indicating label which not only provides the aforementioned deterrents, but further can function as a receipt and which further does not fully display one's signature to potential copyists. These and other objects of the present invention are provided by a tamper indicating label for removable application to an article surface having at least two segments with one segment thereof which is movable relative to the other along a segment dividing line, comprising a first sheet having an upper surface adapted to receive information conveying indicia thereon including the pen imparted signature of the user and a lower opposite surface provided with a layer of pressure sensitive adhesive, a backing sheet having a low adhesion upper surface in mating contact with the adhesive layer of the first sheet, said first sheet including a weakened line dividing said first sheet into two sections when one of said sections is pulled from the backing sheet.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DESCRIPTION OF THE PREFERRED EMBODIMENT

Figure 2:
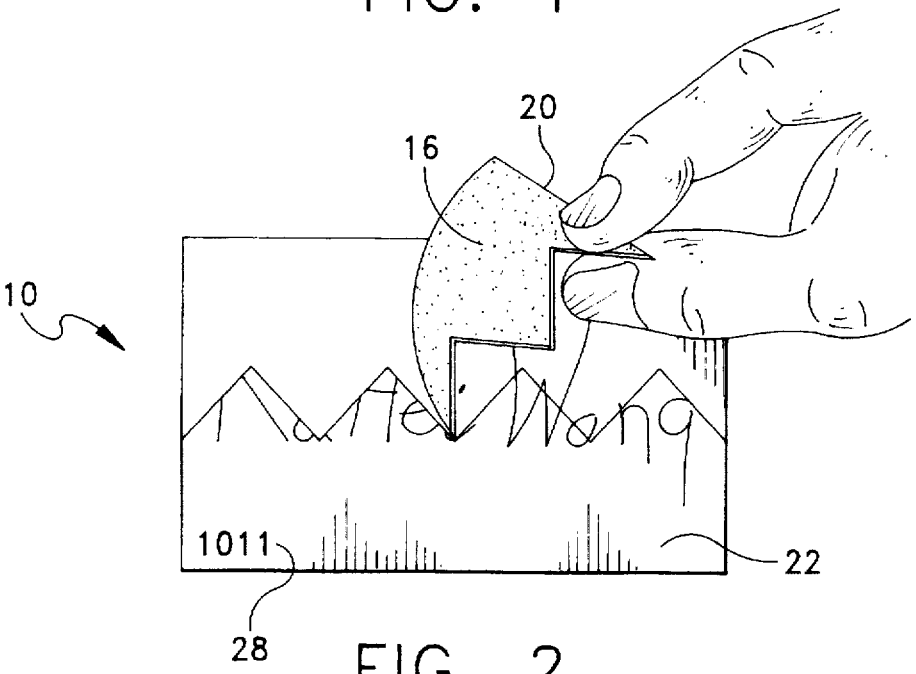
FIG. 2 shows one of the sections of the first or upper sheet of the label in the process of being removed.
Figure 3:
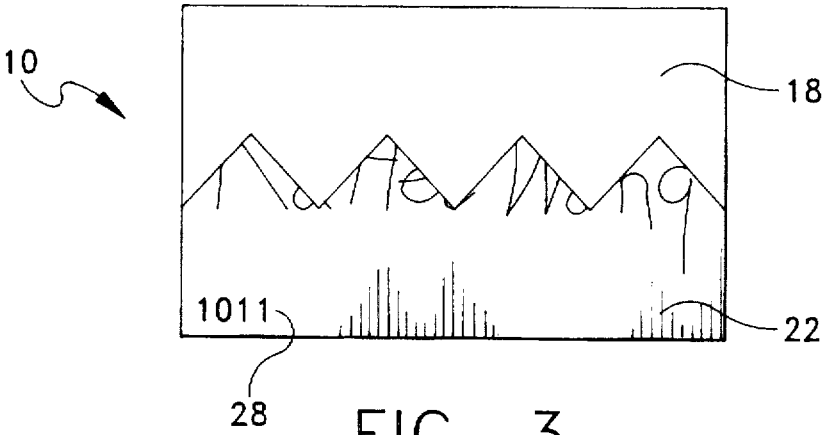
FIG. 3 is a view similar to FIGS. 1 and 2 but showing the first section of the upper sheet completely removed.
Figure 4:
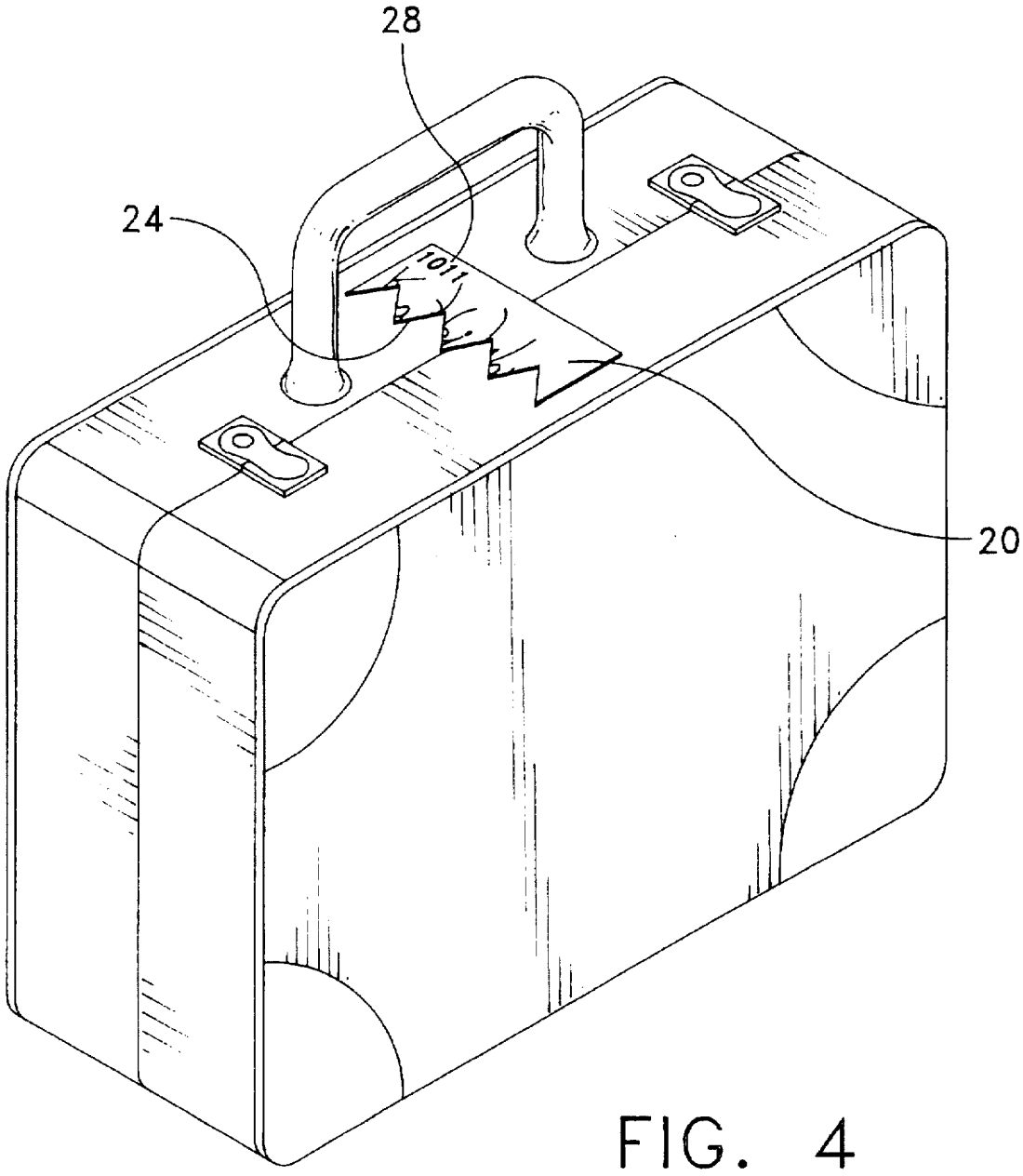
FIG. 4 is a perspective view showing the first section of the label removed from the backing sheet and applied across the segment dividing line of the article to which it is applied which in this case is a suitcase.
Figure 5:
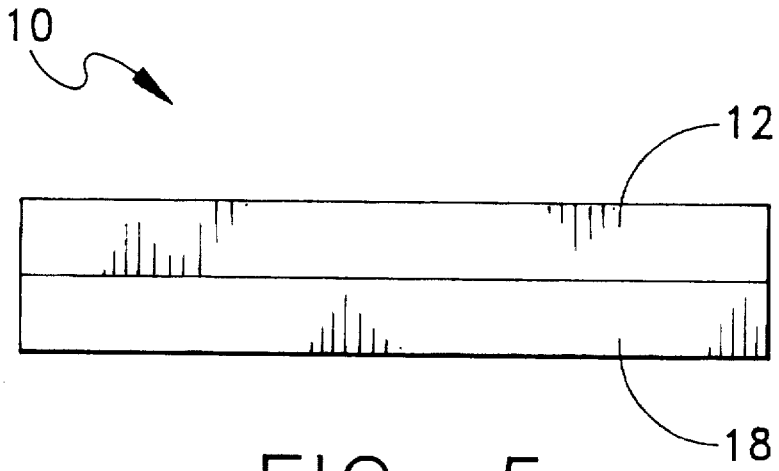
FIG. 5 is a front elevational view on an enlarged scale showing the two sheets of the label attached to each other.

FIGS. 1 through 5 of the drawings describe the invention in its preferred form. Therein the label 10 is depicted as provided in a general rectangular configuration although any geometric or irregular shape desired may be employed. The label includes a first or upper sheet 12 having an upper surface 14 and a lower surface 16. Generally, the type of material from which the first sheet should be made is some type of paper—the upper surface of which is easily inscribed by suitable instruments such as a pen or pencil with markings such as one's signature and capable of being preprinted by commonly available processes. The upper sheet 12 should also readily receive an adhesive layer on the rear or lower surface 16 thereof and which adhesive when the label or segment thereof is applied to the article as shown in FIG. 4 will make the label difficult to remove therefrom without indicating such removal. Such overall removal indicating feature can be accomplished by numerous methods such as by providing a relatively weak paper sheet which highly resists removal or by providing a very high-tack adhesive layer on the reverse thereof or some combination of both. It also should be brought out that while this feature of making it noticeable that a section of the first sheet had been removed or had been attempted to be removed from the article as shown in FIG. 4 is highly desirable, some other features of the present invention such as the ability of the two separate sections to operate as a receipt by the matching of the weakened lines that separate such as will hereinafter be more fully brought out can be achieved without such previously above-indicated provision.

Figure 1:
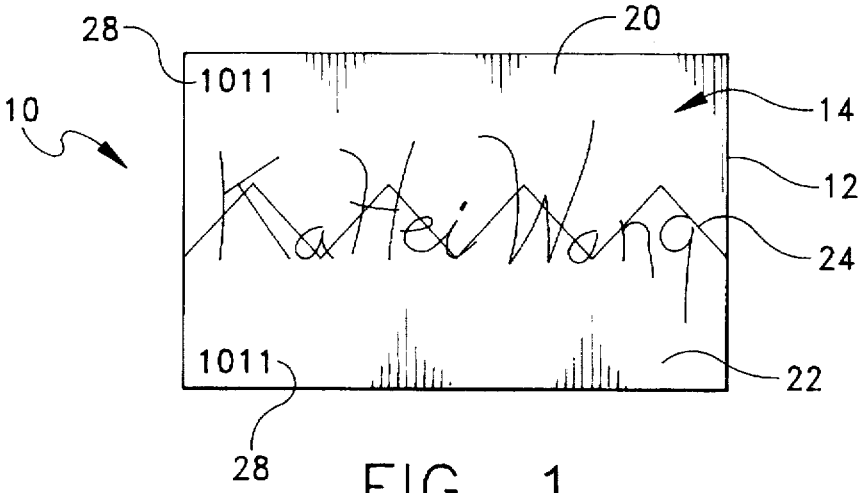
FIG. 1 is a top plan view of a label made in accordance with the present invention prior to its disassembly and use on an article.

Accordingly as best shown by referring to FIGS. 1 through 3 in their numerical sequence, the first or upper sheet 12 is divided into at least two segments or sections 20 and 22 by a weakened line 24 extending thereacross so as to divide the first sheet 12 into such sections. The weakened line 24 may be laterally formed across the face of the label 10 as depicted or may be diagonally placed so long as adequate surface is provided such that indicia may be easily imparted to the upper surface 14 as by pencil or pen. In the present instance, the inventor's name is written across the sheet 12 in the vicinity of the weakened line 24 such that a portion of his signature appears in section 20 and the remaining portion appears in section 22. In this way, it can seen that when the upper section 20 is peeled off and placed on the article such as the suitcase as shown in FIG. 4, the lower segment or section 22 remains on the backing sheet 18 and thus can be used as a receipt for retrieving the suitcase at the destination point. Bearing in mind that duplicate serial numbers could also be imprinted on both sections 20 and 22 if desired, for purposes of this invention, the signature or other indicia primarily known and easily duplicable solely by the owner is placed across the weakened line portion of the upper surface 14 when both sections 20 and 22 are connected to each other.

It should also be noted that it is preferable to provide the weakened line in a non-linear form, that is, not in a straight line, and the complex zigzag patterns shown by the reference numeral 24 is suitable for such purpose. Such zigzag configuration imparts an irregular dividing line between the sections 20 and 22 and therefore makes it more difficult for one to determine the name or message that has been inscribed or otherwise provided on the upper surface 14 of the first sheet 12 and which can later be used as a receipt, that is, the portion remaining after the upper section 20 has been removed from the label and as shown in FIG. 3. In other words when the owner retaining the receipt as shown in FIG. 3 reclaims the baggage, the baggage handler can easily utilize such receipt to determine or confirm that the second section 22 forms the remainder of or completes the message imparted to the sheet 20 and thus serves as an additional security feature.

A good quality white paper such as chrome coated paper produced by all major paper manufacturers may be utilized for the first sheet 12, and such may be commercially provided with the adhesive layer on the rear surface 16 thereof. The backing layer 18 formed from a preferably more tear resistant paper substrate and provided with a low adhesion upper surface contacts the adhesive backed surface 16. In that regard, the material utilized in the manufacture of self-adhesive data labels such as provided by Dennison Manufacturing Company of Framingham, Mass. 01701 may be utilized for such purpose. The weakened line can be formed by cutting through the first sheet in the form of a series of cuts or perforations as is known in the art.

Figure 6:
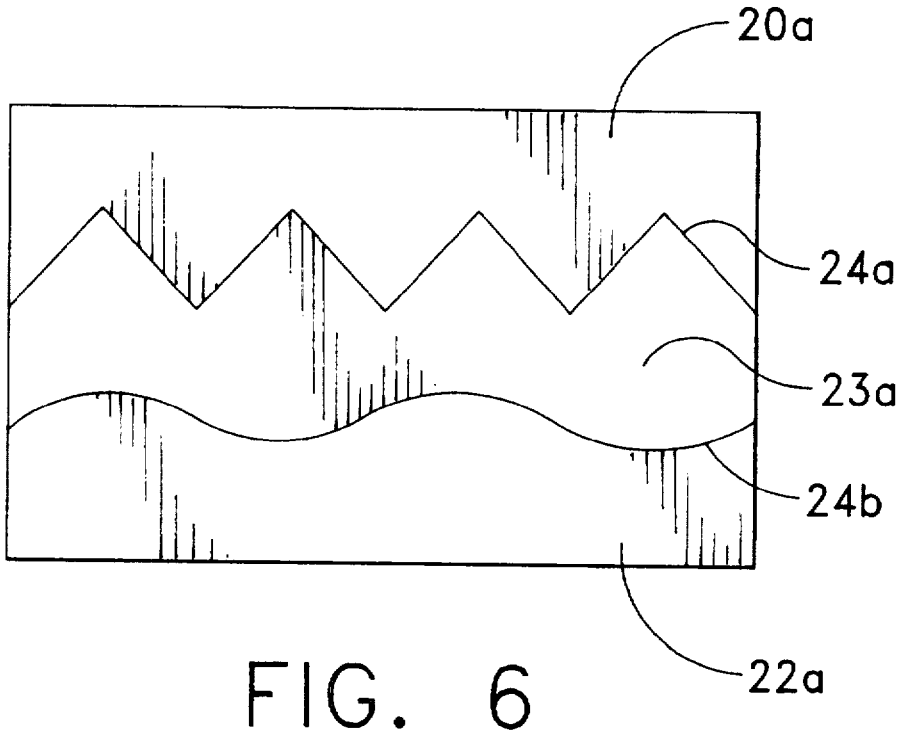
FIG. 6 is a top plan view of an alternate form of the label in which both zigzag and curvilinear weakened lines are provided and in which more than one weakened line is provided in the same label.

Referring now to FIG. 6, a modified form of the present invention is shown in which more than one weakened line 24 is provided, that is, weakened line **24*a*, in which a zigzag configuration is utilized and weakened line 24*b* in which a wavy line is utilized. Such indicates that not only may the weakened line or lines take various forms but more than one weakened line may be utilized such that the front face, that is, the upper surface 14 of the first sheet 12, is divided into more than two sections. Thus when the identifying indicia such as the owner's signature is written across the face thereof which preferably should span all three sections as shown in FIG. 6, any one of the three sections thus formed may be utilized as the removable portion of the label that is placed upon the article such as the luggage to be protected. Alternatively, two sections could be removed from the label and utilized as the security device, but it is contemplated in the configuration shown in FIG. 6 that the central section 23*a* would be the section removed and then matched with the upper and lower sections 20*a* and 22*a*. In addition, matching UPC codes or serial numbers 28 on each section as depicted in FIGS. 1–3** could be utilized to reduce chances of fraudulent reproduction as could the use of holograms, colored and/or safety paper, e.g., patterned, as is commonly utilized for bank checks. Also, the adhesive could be of the type that once applied to a surface, e.g., the suitcase, after stripping the backing sheet therefrom, the tackiness of the adhesive clings to such surface and cannot be re-utilized, that is, once the removed section is applied to a surface, it cannot be utilized again. In addition in some cases, it is also desirable to perforate the backing sheet along the weakened line as well as the first sheet so that both the first section and its underlying portion of the backing sheet is removed along the weakened line such that the receipt portion, that is, the second section of the first sheet and its underlying portion of the backing sheet become the receipt so that it is easier to line up or mate the two thus severed portions. In effect, this alternative would enable the above-described portions to be physically butted against each other along the mating weakened lines in face to face contact.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A tamper indicating label for removable application to an article surface having at least two segments with one segment thereof which is movable relative to the other along a segment dividing line, comprising a first sheet having an upper surface adapted to receive information conveying indicia thereon including the pen imparted signature of the user and a lower opposite surface provided with a layer of pressure sensitive adhesive, a backing sheet having a low adhesion upper surface in mating contact with the adhesive layer of the first sheet, said first sheet including a weakened line dividing said first sheet into two sections when one of said sections is pulled from the backing sheet.

2. The label of claim 1, said weakened line being of non linear configuration.

3. The label of claim 2, said weakened line of zigzag configuration.

4. The label of claim 1, there being two weakened lines separated from each other and dividing the first sheet into three sections each separable from each other.

5. The label of claim 1, said first sheet lower surface adhesive layer of a high-tack adhesive.

6. The method of utilizing a tamper indicating label of the type having a first sheet having an upper surface adapted to receive information conveying indicia thereon including the pen imparted signature of the user and a lower opposite surface provided with a layer of high-tack pressure sensitive adhesive, a backing sheet having a low adhesion upper surface in mating contact with the adhesive layer of the first sheet and wherein the first sheet includes a weakened line dividing said first sheet into two sections when one of said sections is pulled from the backing sheet, comprising writing indicia in the user's handwriting on the upper surface of the first sheet so that the indicia spans said weakened line and is thus partially contained in each of the two sections defined by the weakened line, peeling off one of the sections with part of the indicia on the top surface thereof from the backing sheet and adhesively applying such one section with its upper surface uppermost across the segment dividing line of an article surface having at least two segments with one of such segments movable relative to the other, checking such article beyond the observant view of the user, and retaining the other section as a tamper deterrent.

7. The method of claim 6, wherein said retained other section is utilized as a claim check and is presented to the person temporarily in custody of such checked article.

* * * * *